US011149331B2

(12) United States Patent
Liu et al.

(10) Patent No.: US 11,149,331 B2
(45) Date of Patent: Oct. 19, 2021

(54) ALUMINUM IRON ALLOY HAVING AT LEAST TWO PHASES

(71) Applicant: GM GLOBAL TECHNOLOGY OPERATIONS LLC, Detroit, MI (US)

(72) Inventors: Zhongyi Liu, Troy, MI (US); Bin Hu, Shanghai (CN); James R. Salavador, Royal Oak, MI (US); Daad B. Haddad, Sterling Heights, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 37 days.

(21) Appl. No.: 16/541,769

(22) Filed: Aug. 15, 2019

(65) Prior Publication Data

US 2021/0047712 A1 Feb. 18, 2021

(51) Int. Cl.

| | |
|---|---|
| ***C22C 38/14*** | (2006.01) |
| ***C22C 38/02*** | (2006.01) |
| ***C22C 38/06*** | (2006.01) |

(52) U.S. Cl.

CPC ..... *C22C 38/14* (2013.01); *C22C 38/02* (2013.01); *C22C 38/06* (2013.01)

(58) Field of Classification Search

None

See application file for complete search history.

(56) References Cited

U.S. PATENT DOCUMENTS 3,582,323 A * 6/1971 Sawyer et al. ..... C22C 38/06 420/77
2014/0030544 A1* 1/2014 Maki ..... C22C 38/20 428/632
2017/0073789 A1* 3/2017 Schuhmacher ..... C21D 9/0068
2019/0352748 A1* 11/2019 Liu ..... C22C 33/006

FOREIGN PATENT DOCUMENTS

WO WO-2015173023 A1 * 11/2015 ..... C23C 14/30

OTHER PUBLICATIONS

Li et al. (The Al-rich Part of the Fe—Al Phase Diagram), Journal of Phase Equilibria and Diffusion, vol. 37 (2), 2016, pp. 162-173 (Year: 2016).*

Palm, M. (Concepts derived from phase diagram studies for the strengthening of Fe—Al based alloys), Intermetallics 13 (2005) pp. 1286-1295. (Year: 2007).*

Raghavan (Al—Fe—Zr (Aluminum-Iron-Zirconium)) ,Journal of Phase Equilibria and Diffusion vol. 31 No. 5 (2010) pp. 459-462 (Year: 2010).*

Titran et al. (High Temperature Properties of Equiatomic FeAl with Ternary Additions), NASA Technical Memorandum 86938 (1984) pp. 1-12 (Year: 1984).*

Schmitt et al. (Creep of binary Fe-Alloys with ultrafine lamellar microstructures), Intermetallics 90 (2017) pp. 180-187. (Year: 2017).*

* cited by examiner

*Primary Examiner* — David Sample

*Assistant Examiner* — Elizabeth Collister

(74) *Attorney, Agent, or Firm* — Cantor Colburn LLP

(57) ABSTRACT

In an embodiment, a high temperature component comprises an aluminum iron alloy. The aluminum iron alloy comprises 52 to 61 atomic percent of aluminum based on the total atoms of aluminum and iron and comprises a first, B2 phase comprising FeAl and a second, triclinic phase comprising $FeAl_2$. The aluminum iron alloy can comprise an additional element, for example, at least one of silicon or zirconium.

7 Claims, 2 Drawing Sheets

ALUMINUM IRON ALLOY HAVING AT LEAST TWO PHASES

INTRODUCTION

Aluminum alloys have been widely used in many applications due to their high strength to weight ratio. Unfortunately though, the inherent limitations of aluminum alloys at high temperatures, such as those greater than 200 degrees Celsius (° C.), often preclude its use from applications that might experience such elevated temperatures.

Many attempts have been made to increase the temperature capability of aluminum alloys. For example, aluminum alloys containing iron or chromium have been developed, for example, Al—Fe—Ce, Al—Fe—V—Si, and Al—Cr—Zr—Mn. However, these alloys often exhibit a degradation in strength at higher temperatures, as well as a lower ductility and fracture toughness than other available aluminum alloys. Aluminum alloys such as Al—Mg and Al—Ti have also been developed and, although these alloys can have promising strength at high temperatures, they often have lower ductility and fracture toughness than many other aluminum alloys.

Accordingly, it would be desirable to develop an aluminum alloy with improved capabilities at high temperatures.

SUMMARY

In one exemplary embodiment, a high temperature component for a vehicle comprises an aluminum iron alloy comprising aluminum and iron. The aluminum iron alloy can comprise 52 to 61 atomic percent of aluminum based on the total atoms of aluminum and iron. The aluminum iron alloy can comprise a first, B2 phase having a first formula FeAl and a second, triclinic phase having a second formula $FeAl_2$. A Vickers hardness value of the aluminum iron alloy of the high temperature component can be greater than or equal to 650 kilograms of force per millimeter squared at 23° C. before and after annealing at 950° C. for 24 hours as determined in accordance with E92-17. The high temperature component can be a structural jacket, a rotor, a housing, an impeller, a valve, an injector, a nozzle, a bracket, a duct, a stator assembly, a gearbox, a bearing housing, a dome, a cover, a vane, a stator, a brake drum, a brake pad, a connecting rod, a turbocharger wheel, or a coating.

In addition to one or more of the features described herein, the aluminum iron alloy can further comprise an additional element. The additional element can comprise at least one of B, C, Ce, Co, Cr, Hf, Mn, Mo, Nb, Ni, Re, Si, Ta, Ti, V, W, Y, or Zr.

In addition to one or more of the features described herein, the additional element can comprise at least one of B, C, Ti, Si, Zr, Hf, Nb, Ta, Re, Mo, or W.

In addition to one or more of the features described herein, the aluminum iron alloy can further comprise silicon in the first, B2 phase.

In addition to one or more of the features described herein, the aluminum iron alloy can comprise silicon and the silicon can be present in an amount of 0.5 to 5 weight percent on the total weight of the aluminum iron alloy.

In addition to one or more of the features described herein, the aluminum iron alloy can comprise silicon and the silicon can be present in an amount of 0.5 to 8 atomic percent based on the total atoms in the aluminum iron alloy.

In addition to one or more of the features described herein, the aluminum iron alloy can further comprise zirconium.

In addition to one or more of the features described herein, the aluminum iron alloy can further comprise zirconium and the zirconium can be present in a third, $\tau_1$ phase having a third formula $Al_8Fe_4Zr$.

In addition to one or more of the features described herein, the aluminum iron alloy can comprise 0.5 to 5 weight percent of zirconium based on the total weight of the aluminum iron alloy or 0.5 to 5 atomic percent of zirconium based on the total atoms in the aluminum iron alloy.

In addition to one or more of the features described herein, the Vickers hardness values of the aluminum iron alloy before and after annealing can be within 10% of each other.

In addition to one or more of the features described herein, the aluminum iron alloy can have a density of less than or equal to 5.5 grams per cubic centimeter.

In addition to one or more of the features described herein, the aluminum iron alloy can comprise 40 to 48 atomic percent of iron based on the total atoms of the aluminum and iron, or 50 to 65 weight percent of iron based on the total weight of the aluminum iron alloy.

In yet another exemplary embodiment, a high temperature component comprises an aluminum iron alloy that comprises aluminum, iron, silicon, and zirconium. The aluminum iron alloy can comprise 52 to 61 atomic percent of aluminum based on the total atoms of aluminum and iron. The aluminum iron alloy can comprise a first, B2 phase having a first formula FeAl; a second, triclinic phase having a second formula $FeAl_2$; and a third, $\tau_1$ phase having a third formula $Al_8Fe_4Zr$. The silicon can be located in the first, B2 phase. A Vickers hardness value of the aluminum iron alloy of the high temperature component can be greater than or equal to 650 kilograms of force per millimeter squared at 23° C. before and after annealing at 950° C. for 24 hours as determined in accordance with E92-17. The high temperature component can be a structural jacket, a rotor, a housing, an impeller, a valve, an injector, a nozzle, a bracket, a duct, a stator assembly, a gearbox, a bearing housing, a dome, a cover, a vane, a stator, a brake drum, a brake pad, a connecting rod, a turbocharger wheel, or a coating.

In addition to one or more of the features described herein, the aluminum iron alloy can comprise 0.5 to 5 atomic percent of the zirconium based on the total atoms in the aluminum iron alloy.

In addition to one or more of the features described herein, the aluminum iron alloy can comprise 0.5 to 8 atomic percent of the silicon based on the total atoms in the aluminum iron alloy.

In addition to one or more of the features described herein, the aluminum iron alloy can consist essentially of the aluminum, iron, silicon, and zirconium.

In addition to one or more of the features described herein, the Vickers hardness values before and after annealing can be within 10% of each other.

In addition to one or more of the features described herein, the aluminum iron alloy can have a density of less than or equal to 5.5 grams per cubic centimeter.

In addition to one or more of the features described herein, the aluminum iron alloy can comprise 0.5 to 5 atomic percent of the zirconium based on the total atoms in the aluminum iron alloy, 0.5 to 8 atomic percent of the silicon based on the total atoms in the aluminum iron alloy, and 40 to 48 atomic percent of iron based on the total atoms of the aluminum and iron.

In addition to one or more of the features described herein, the aluminum iron alloy can comprise 40 to 48 atomic percent of iron based on the total atoms of the aluminum and iron; or 50 to 65 weight percent of iron based on the total weight of the aluminum iron alloy.

The above features and advantages, and other features and advantages of the disclosure are readily apparent from the following detailed description when taken in connection with the accompanying drawings and claims.

BRIEF DESCRIPTION OF THE DRAWINGS

Other features, advantages, and details appear, by way of example only, in the following detailed description, the detailed description referring to the drawings, in which.

DETAILED DESCRIPTION

Figure 1:
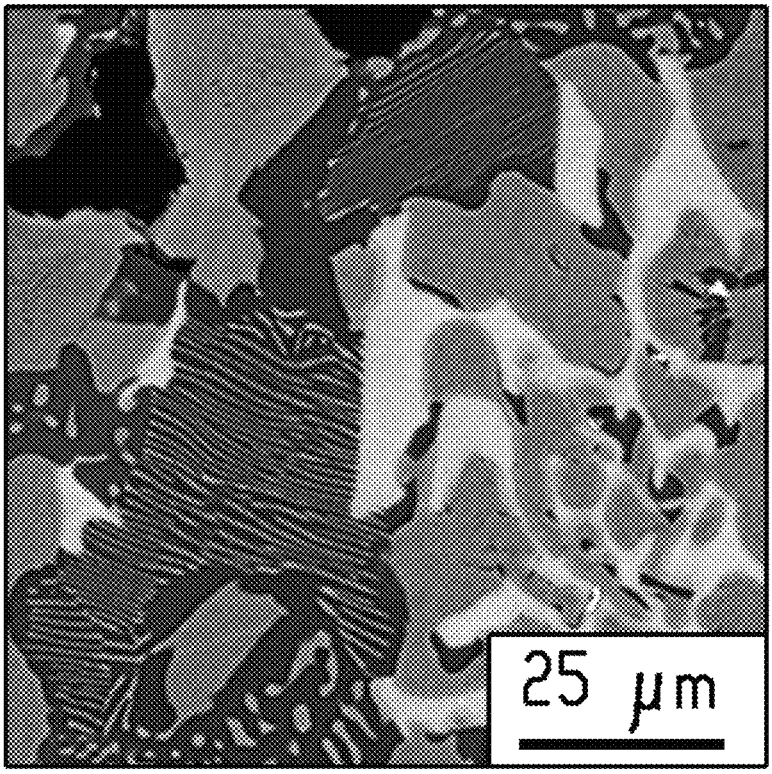
FIG. 1 is a backscattered electron image of the aluminum iron alloy of the example.

The following description is merely exemplary in nature and is not intended to limit the present disclosure, its application, or uses.

Single, B2 phase based Al—Fe alloys having a 1:1 atomic ratio have been widely studied due to their excellent corrosion and oxidation resistance and low density (about 6.3 grams per cubic centimeter) when compared to steel. These single-phase materials though have poor mechanical properties at high temperatures, precluding them from use in such applications. It was discovered that an aluminum iron alloy containing an increased amount of aluminum of 52 to 61 atomic percent of aluminum based on the total atoms of aluminum and iron can result in a lightweight material that can be used in high temperature applications. This ability to withstand high temperature can be particularly important for use in components that experience high temperatures during use, such as many components used in vehicles. In other words, the high temperature component can experience high temperatures during its use. As used herein, the term high temperature can refer to temperatures of greater than or equal to 250° C., 250 to 960° C., or 300 to 800° C.

The increased amount of aluminum results in the formation of a two-phase aluminum iron alloy that comprises both a B2 phase containing FeAl having a simple cubic structure and a second phase containing $FeAl_2$ having a triclinic structure. Without intending to be bound by theory, it is believed that the two phases of the aluminum iron alloy form lamellar regions and that the high temperature mechanical properties increase due to the presence of these stable lamellae. The improvement in the high temperature properties can be seen when considering the Vickers hardness values before and after annealing, where an alloy that is stable at high temperatures will not exhibit a significant decrease in the Vickers hardness after annealing. The present aluminum iron alloy can have a Vickers hardness of greater than or equal to 650 kilograms of force per millimeter squared, or 700 to 780 kilograms of force per millimeter squared at room temperature, for example, 23° C. before and after annealing at 950° C. for 24 hours. The Vickers hardness values before and after annealing can be within 10%, or within 1% of each other. After the annealing the aluminum iron alloy can be cooled to room temperature at a rate of −1 to −100° C. per second (° C./s), for example, −10° C./s. These values are significantly greater than the Vickers hardness of only 470 kilograms of force per millimeter squared of a single, B2 phase aluminum iron alloy. As used herein, the Vickers hardness can be determined in accordance with ASTM E92-17.

Likewise, the improvement in the high temperature properties can be seen when considering the compression strength before and after annealing, where the compression strength at a given strain from 0 to 2% can be the same, for example, within 5%, or within 1% of each other, before and after annealing at 950° C. for 24 hours. Moreover, the aluminum iron alloy can have at least one of a high compression strength of greater than or equal to 1,500 megapascal at a 2% strain, or a Young's modulus of greater than or equal to 160 gigapascals, both before and after annealing at 950° C. for 24 hours. These values are significantly greater than the compression strength and the Young's modulus of grey cast iron.

The aluminum iron alloy has the additional benefit of a reduced density as compared to aluminum iron alloys having only the B2 phase. For example, the present aluminum iron alloy can have a density of less than or equal to 5.5 grams per cubic centimeter.

The aluminum iron alloy can comprise 52 to 61 atomic percent of aluminum based on the total atoms of aluminum and iron. The aluminum iron alloy can comprise 40 to 48 atomic percent of iron based on the total atoms of the aluminum and iron. The aluminum iron alloy can comprise 33 to 50 weight percent, or 35 to 50 weight percent of aluminum based on the total weight of the aluminum iron alloy. The aluminum iron alloy can comprise 50 to 67 weight percent, or 50 to 65 weight percent of iron based on the total weight of the aluminum iron alloy.

The aluminum iron alloy can comprise an additional element. The additional element can comprise at least one of B, C, Ce, Co, Cr, Hf, Mn, Mo, Nb, Ni, Re, Si, Ta, Ti, V, W, Y, or Zr. The aluminum iron alloy can comprise at least one of Si or Zr that can optionally occupy an aluminum sublattice location. The aluminum iron alloy can comprise at least one of Ti, Si, Zr, Hf, Nb, Ta, Re, Mo, or W that can optionally occupy an iron sublattice location. The aluminum iron alloy can comprise at least one of B or C that can optionally occupy an interstitial location. The aluminum iron alloy can comprise 0.5 to 8 atomic percent, or 1.5 to 5 atomic percent of each additional element independently based on the total atoms in the aluminum iron alloy. The aluminum iron alloy can comprise at most 20 atomic percent, or at most 10 atomic percent of the additional element based on the total atoms in the aluminum iron alloy. The aluminum iron alloy can comprise 0 to 5 weight percent, or 0.5 to 5 weight percent of each additional element independently based on the total weight of the alloy.

The additional element can comprise silicon. The silicon is soluble in the B2 and can dissolve therein, localizing to an iron site or an aluminum site. The incorporation of the silicon can further strengthen the aluminum iron alloy. The aluminum iron alloy can comprise 0.5 to 5 weight percent of silicon based on the total weight of the aluminum iron alloy. The aluminum iron alloy can comprise 0.5 to 8 atomic percent of silicon based on the total atoms in the aluminum iron alloy.

The presence of the additional element can result in the formation of a third phase. For example, if the aluminum iron alloy comprises zirconium, then the aluminum iron alloy can comprise a third, Ti phase having the formula $Al_8Fe_4Zr$. The formation of the third phase can also further strengthen the aluminum iron alloy. The aluminum iron alloy can comprise 0.5 to 5 weight percent of zirconium based on the total weight of the aluminum iron alloy. The aluminum iron alloy can comprise 0.5 to 5 atomic percent of zirconium based on the total atoms in the aluminum iron alloy.

The aluminum iron alloy can be formed by melting a raw material comprising aluminum, iron, and an optional additional element at a temperature of greater than or equal to 1,000° C., or greater than or equal to 1,200° C. in the air or in an inert atmosphere to form a melted mixture. The melted mixture can comprise 52 to 61 atomic percent of aluminum based on the total atoms of aluminum and iron. The melted mixture can be cast to form an article having a desired shape. The melted mixture can be cooled to form the aluminum iron alloy. The cooling can occur at a rate of −1 to −100° C. per second (° C./s), or −10 to −100° C./s if at the solidus point, otherwise, the cooling rate can be much lower. The article can be annealed if desired. The annealing can occur at a temperature of 900 to 1,000° C. The annealing can occur for 1 to 48 hours. After forming the aluminum iron alloy, the aluminum iron alloy can be formed into a plurality of particulates and can optionally be mixed with a matrix material to form a composite structure.

The aluminum iron alloy can be used in monolithic form or can be a particulate and optionally mixed with a separate material to produce metal-matrix composites. The aluminum iron alloy can be used in applications requiring high strength at temperatures of greater than 250° C. The aluminum iron alloy can be used for various high temperature applications, for example, in aerospace applications or engine applications. An article can comprise the aluminum iron alloy. The article can be a structural jacket, a housing, an impeller, a valve, an injector, a nozzle, a bracket, a duct, a stator assembly, a gearbox, a bearing housing, a dome, a cover, a vane, a stator, a rotor (for example, a brake rotor or a turbine rotor), a brake drum, a brake pad, a connecting rod, a turbocharger wheel, a coating, or another structural component.

The following example is provided to illustrate the present disclosure. The example is merely illustrative and is not intended to limit devices made in accordance with the disclosure to the materials, conditions, or process parameters set forth therein.

An aluminum iron alloy was formed by melting a mixture comprising 50 atomic percent aluminum, 42 atomic percent iron, 6 atomic percent silicon, and 2 atomic percent zirconium at 1,200° C. in air and sand casting to form the aluminum iron alloy. A backscattered electron (BSE) image was taken of the aluminum iron alloy and is shown in FIG. 1. In FIG. 1, the white regions are the $\tau_1$ phase having the formula $Al_8Fe_4Zr$, the light gray regions are the B2 phase having the formula FeAl and comprising the silicon, and the dark gray regions are the triclinic phase having the formula $FeAl_2$. FIG. 1 clearly shows the lamellae formation of the B2 phase and the triclinic phase.

Figure 2:
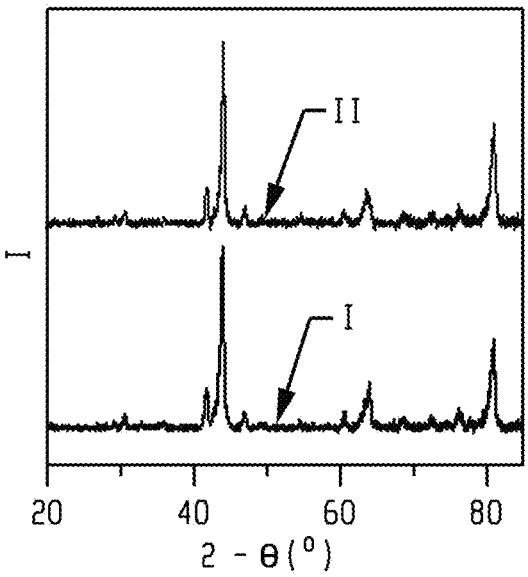
FIG. 2 is a graphical illustration of the x-ray diffraction results of the example.

A portion of the aluminum iron alloy was annealed at 950° C. for 24 hours and the annealed alloy was compared to the as-cast alloy using x-ray diffraction, by determining the Vickers hardness, and by determining the compression strength up to a 2% strain. FIG. 2 shows the x-ray diffraction results for the as-cast (I) and the annealed (II) aluminum iron alloy. The x-ray diffraction shows that aluminum iron alloy has a stable microstructure in that it was relatively unchanged even after annealing at 950° C. for 24 hours.

Figure 3:
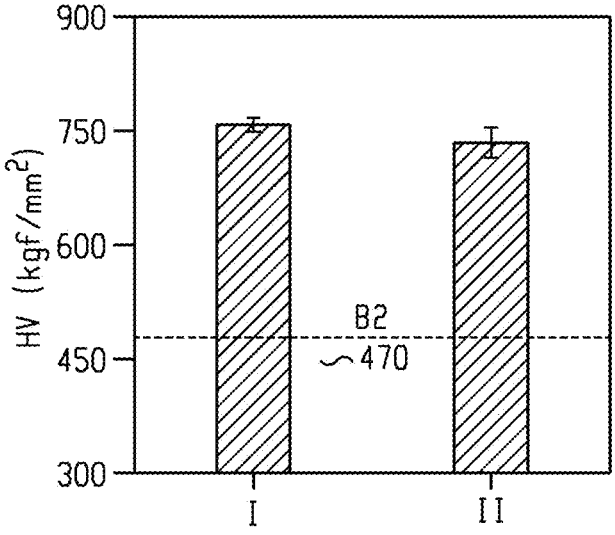
FIG. 3 is a graphical illustration of the Vickers hardness results of the example.
Figure 4:
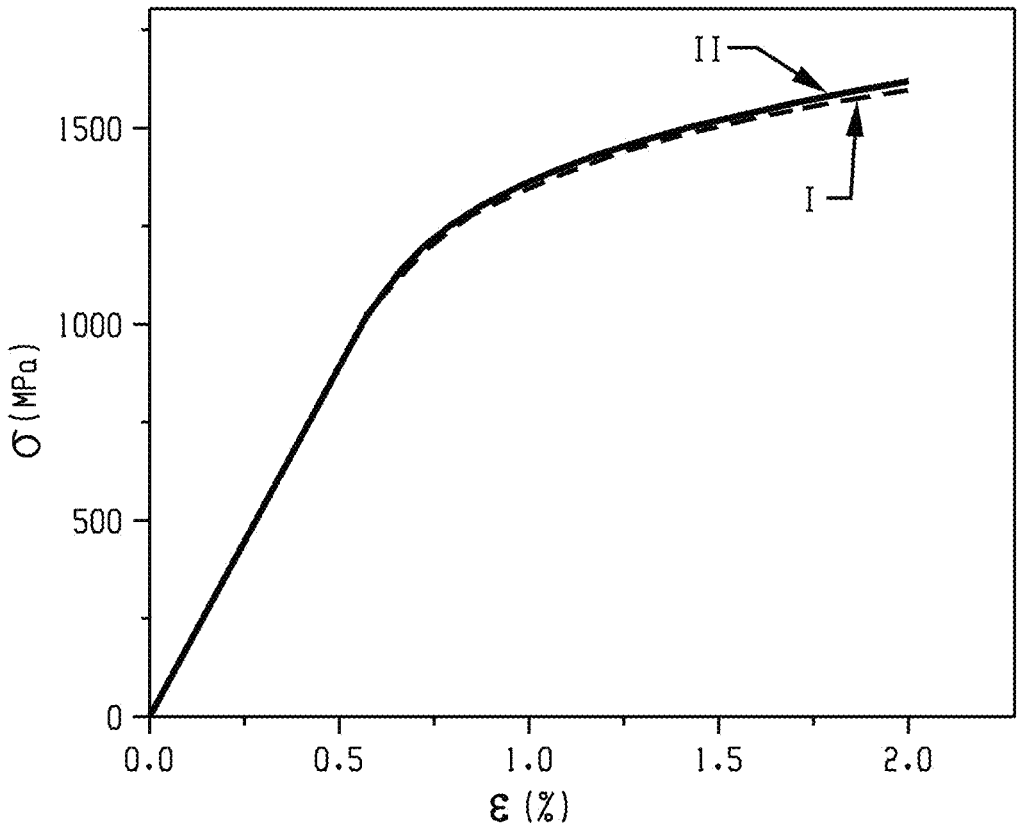
FIG. 4 is a graphical illustration of the compression strength of the example at strains to 2%.

FIG. 3 shows that the as-cast aluminum iron alloy and the annealed aluminum iron alloy have approximately the same Vickers hardness values of about 750 kilograms of force per millimeter squared. FIG. 3 also shows a dotted horizontal line at about 470 kilograms of force per millimeter squared, the value of the Vickers hardness of a single, B2 phase aluminum iron alloy. FIG. 3 therefore also clearly illustrates the improvement in Vickers hardness of the present aluminum iron alloy of almost 100% relative to a single, B2 phase aluminum iron alloy. FIG. 4 shows that the as-cast (I) aluminum iron alloy and the annealed (II) aluminum iron alloy have approximately the same compression strength at strains up to 2%.

The compositions, methods, and articles can alternatively comprise, consist of, or consist essentially of, any appropriate materials, steps, or components herein disclosed. The compositions, methods, and articles can additionally, or alternatively, be formulated so as to be devoid, or substantially free, of any materials (or species), steps, or components, that are otherwise not necessary to the achievement of the function or objectives of the compositions, methods, and articles.

The terms "a" and "an" do not denote a limitation of quantity, but rather denote the presence of at least one of the referenced item. The term "or" means "and/or" unless clearly indicated otherwise by context.

Reference throughout the specification to "a feature", "an embodiment", "another embodiment", "some embodiments", and so forth, means that a particular element (e.g., feature, structure, step, or characteristic) described in connection with the embodiment is included in at least one embodiment described herein, and may or may not be present in other embodiments. In addition, it is to be understood that the described elements may be combined in any suitable manner in the various embodiments.

The endpoints of all ranges directed to the same component or property are inclusive of the endpoints, are independently combinable, and include all intermediate points and ranges. For example, a range of "5 to 20 weight percent" is inclusive of the endpoints and all intermediate values of the ranges such as 10 to 19 weight percent, etc. The term "at least one of" means that the list is inclusive of each element individually, as well as combinations of two or more elements of the list, and combinations of at least one element of the list with like elements not named. Unless defined otherwise, technical and scientific terms used herein have the same meaning as is commonly understood by one of skill in the art to which this disclosure belongs.

While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof. Therefore, it is intended that the present disclosure not be limited to the particular embodiments disclosed, but will include all embodiments falling within the scope thereof.

What is claimed is:

1. A high temperature component for a vehicle comprising an aluminum iron alloy, wherein the aluminum iron alloy comprises:

aluminum, iron, silicon, and an additional element, wherein the additional element is at least one of boron, cerium, cobalt, hafnium, manganese, rhenium, tungsten, and yttrium; and wherein the aluminum iron alloy comprises 52 to 56 atomic percent of aluminum based on the total atoms of the aluminum iron alloy, 40 to 48 atomic percent of iron based on the total atoms of the aluminum iron alloy, 2 to 8 atomic percent of silicon based on the total atoms of the aluminum iron alloy, and 2 to 8 atomic percent of the additional element based on the total atoms of the aluminum iron alloy;

wherein the aluminum iron alloy comprises a first, B2 phase having a first formula FeAl, a second, triclinic phase having a second formula $FeAl_2$, and a third, $\tau_1$ phase comprising the additional element, and wherein the silicon is located in the first, B2 phase;

wherein a Vickers hardness value of the aluminum iron alloy is greater than or equal to 650 kilograms of force per millimeter squared at 23° C. before and after annealing at 950° C. for 24 hours, wherein the Vickers hardness is determined in accordance with E92-17; and wherein the high temperature component is a structural jacket, a rotor, a housing, an impeller, a valve, an injector, a nozzle, a bracket, a duct, a stator assembly, a gearbox, a bearing housing, a dome, a cover, a vane, a stator, a brake drum, a brake pad, a connecting rod, a turbocharger wheel, or a coating.

2. The high temperature component of claim 1, wherein the silicon is present in an amount of 6 atomic percent based on the total atoms in the aluminum iron alloy.

3. The high temperature component of claim 1, wherein the aluminum iron alloy further comprises zirconium.

4. The high temperature component of claim 3, wherein the aluminum iron alloy comprises 0.5 to 5 weight percent of zirconium based on the total weight of the aluminum iron alloy; or 0.5 to 5 atomic percent of zirconium based on the total atoms in the aluminum iron alloy.

5. The high temperature component of claim 1, wherein the Vickers hardness values of the aluminum iron alloy before and after annealing are within 10% of each other.

6. The high temperature component of claim 1, wherein the aluminum iron alloy has a density of less than or equal to 5.5 grams per cubic centimeter.

7. The high temperature component of claim 1, wherein the aluminum iron alloy comprises 42 atomic percent of iron based on the total atoms of the aluminum and iron.

* * * * *